US006607471B2

(12) United States Patent
Reck

(10) Patent No.: US 6,607,471 B2
(45) Date of Patent: Aug. 19, 2003

(54) MOVEMENT TRAINING DEVICE WITH TWO MOVABLE ACTUATING ELEMENTS

(76) Inventor: Martin Reck, Reckstrasse 1-3, D-88422 Betzenweiler (DE)

( * ) Notice: Subject to any disclaimer, the term of this patent is extended or adjusted under 35 U.S.C. 154(b) by 66 days.

(21) Appl. No.: 09/753,706

(22) Filed: Jan. 4, 2001

(65) Prior Publication Data

US 2001/0019985 A1 Sep. 6, 2001

(30) Foreign Application Priority Data

Jan. 4, 2000 (DE) ..... 100 00 135

(51) Int. Cl.[7] ..... A63B 69/00

(52) U.S. Cl. ..... 482/57; 482/51

(58) Field of Search ..... 482/1–9, 51, 52, 482/57–65, 900, 902

(56) References Cited

U.S. PATENT DOCUMENTS 6,142,912 A * 11/2000 Profaci ..... 482/8
6,146,313 A * 11/2000 Whan-Tung et al. ..... 482/51
6,416,442 B1 * 7/2002 Stearns et al. ..... 482/52

* cited by examiner

*Primary Examiner*—Glenn E. Richmon
(74) *Attorney, Agent, or Firm*—Crowell & Moring LLP

(57) ABSTRACT

A movement training device includes two movable actuating elements for a pair of extremities of a person. At least one electric motor drives and/or brakes the actuating elements and an electronic unit regulates and/or controls the movement of the actuating elements. The invention provides sensors for determining extremities-based measurement values that give information about which load is acting on the respective actuating element, whereby on the basis of the extremities-based measurement values of at least one extremity, the electronic unit regulates and/or controls the movement of the actuating elements.

20 Claims, 1 Drawing Sheet

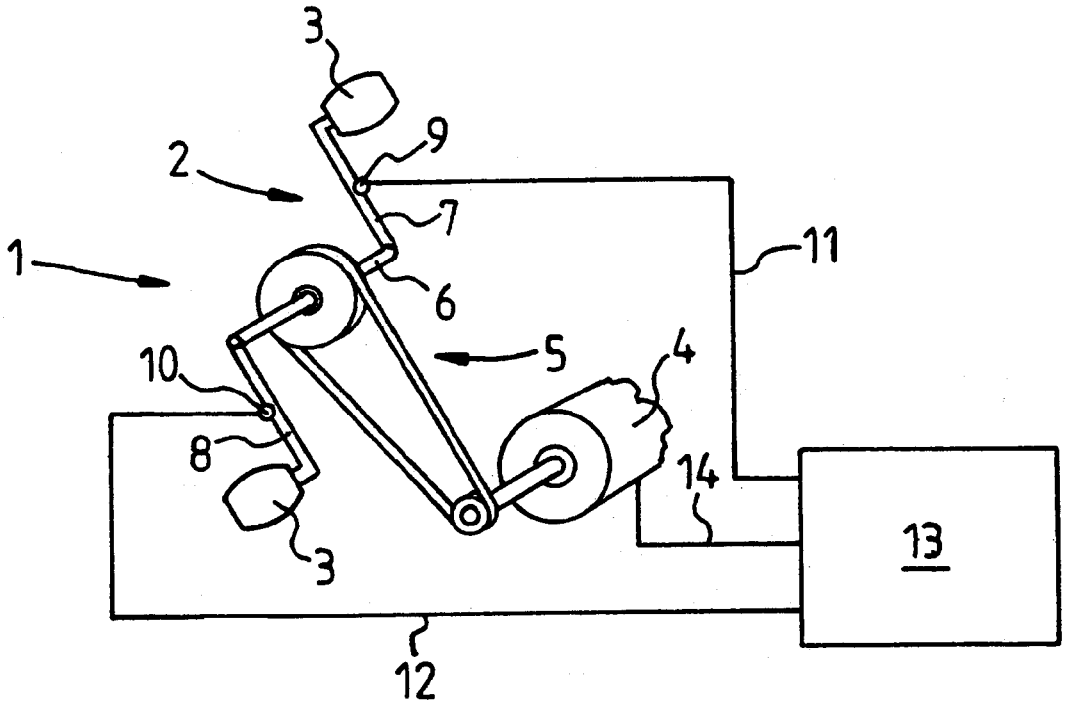
Fig.

MOVEMENT TRAINING DEVICE WITH TWO MOVABLE ACTUATING ELEMENTS

FIELD OF THE INVENTION

The invention relates to a movement training device with two moveable actuating elements for a pair of a person's extremities. The invention also comprises at least one member, preferably an electric motor for driving and/or braking the actuating elements and an electronic unit for regulating and/or controlling the movement of the actuating elements.

BACKGROUND OF THE INVENTION

A movement training device of the above-mentioned type is described in German published patent application DE 198 11 233 A1.

It involves a training device with a crank that is coupled to the feet and arms of a person training. The training device permits one to react to the remaining movement possibilities of a handicapped person in order to guarantee a most effective training routine. To this end, there is provided, in particular, a control or regulating arrangement with different functions to increase the speed as a function of the torque, acting on the crank, by means of a person training so that even very small residual muscle forces can make a contribution to the crank movement in the form of an increase in speed. In this manner, a rotary motion can be favored, for example, by patients, who exhibit unilateral paralysis owing to a stroke, due to which the affected extremity can be moved, if at all, only to a very limited degree.

Such a training device has already been used with success. However, it could be improved especially with respect to the ability to focus on the different sides of an extremity.

SUMMARY OF THE INVENTION

The invention is based on the problem of providing a movement training device of the above-mentioned type wherein one can react to the different movement possibilities of the extremities of a pair of extremities in order to guarantee an improved training routine.

This problem is solved by a movement training device comprising two moveable actuating elements for a pair of extremities of a person. The device includes at least one member for driving and/or braking the actuating elements and an electronic unit for regulating and/or controlling the movement of the actuating elements. The device is characterized by means for determining extremities-based measurement values that give information about which load is acting on the respective actuating element. On the basis of the extremities-based measurement values of at least one extremity, the electronic unit regulates and/or controls the movement of the actuating elements.

The dependent claims disclose advantageous and expedient further developments of the movement training device of the present invention.

The invention is based on a movement training device with two moveable actuating elements for a pair of extremities of a person; at least one member, preferably an electric motor for driving and/or braking the actuating elements; and an electronic unit for regulating and/or controlling the movement of the actuating elements. The central idea of the invention lies in the fact that there are means for determining extremities-based measurement values, which give information about which load is acting on the respective actuating element; and that on the basis of the extremities-based measurement values of at least one extremity, the electronic unit regulates and/or controls the movement of the actuating elements. To date, to regulate and/or control the movement of the crank, a variable that reflects the load on the crank by means of both crank sides has been used to regulate and/or control movement training devices for a pair of extremities. Said devices comprise, for example, a crank driven by an electric motor. Thus, there is, so-to-say, "integral training" for both extremity sides. Now it is possible in an elegant manner with the invention to offer constantly a training form that is optimally coordinated with the movement possibilities of the extremities, e.g. the legs of a person training, since the electronic unit regulates and/or controls the actuating elements of the extremities. That is, in particular the selection of the regulating and/or control functions and/or the combination of a variable for such functions is/are done on the basis of the extremities-based measurement values and not by a summation variable, which reflects only as an integral the load on the actuating elements. Correspondingly the invention is also not supposed to relate to the fact that measurement values that are found on the basis of the extremities are, indeed, obtained, but then they are simply added together for the purpose of forming a variable, which is intended for the regulating and/or control arrangement and that is equivalent to the aforementioned integral summation variable. The goal of the inventive procedure is to optimize specifically the training routine, for example, of a weak leg, as compared to a strong leg of a person training, in such a manner that the result is a comparatively fast recovery or normalization of the sick weak leg.

In a preferred embodiment of the invention the electronic unit selects, as a function of the extremities-based measurement values of at least one extremity, a regulating and/or control function for the purpose of regulating and/or controlling the movement of the actuating elements. At the same time, the extremities-based measurement values can also be used to preset the parameters for the functions. The selection can take place as a function of the measurement values of one or the other extremity or as a function of a combination of the measurement values of the extremities in a specifiable weighting.

In another preferred embodiment of the invention, the electronic unit uses the extremities-based measurement values of at least one extremity as the regulating and/or control variable for a regulating and/or control function for the purpose of regulating and/or controlling the movement of the actuating elements. In another preferred embodiment of the invention, the selection of the regulating and/or control functions as well as the use of the measurement values as the regulating and/or control variable for these functions can be combined as a function of the extremities-based measurement values of at least one extremity. That is, the measurement values of at least one extremity determine the selection of the regulating and/or control function and are simultaneously the regulating and/or control variable in this function.

In an even more preferred embodiment of the invention, the electronic unit uses either the measurement values of one or the other extremity as the regulating and/or control variable for a regulating and/or control function for the purpose of regulating and/or controlling the movement of the actuating elements. The measurement values of one extremity can also be used, for example, only section-by-section. However, a regulating and/or control variable does not have to follow automatically from the measurement values of one or the other extremity; it can also be a combination of these measurement values with different weightings. In so doing, measurement values can also be used only section-by-section. In this manner, for example, the effect of a healthy leg on a sick weak leg during coordinated movement can be determined in a very sensitive manner.

Other objects, advantages and novel features of the present invention will become apparent from the following detailed description of the invention when considered in conjunction with the accompanying drawings.

BRIEF DESCRIPTION OF THE DRAWINGS

One embodiment of the invention is depicted in the drawing and explained with reference to other advantages and details. The FIGURE shows a movement training device, illustrated schematically in functional blocks.

DETAILED DESCRIPTION OF THE DRAWINGS

The movement training device 1 comprises a crank 2 with pedals 3 for the legs of a person training (not illustrated) as well as an electric motor 4, which is connected, for example, by way of a V-belt drive 5 to a shaft 6 of the crank 2. Mounted on the crankarms 7, 8 of the crank 2 are sensors 9, 10 in the form of, for example, rotating measuring tapes, in order to measure the amount, reflected by the torque or the force, acting on the respective crankarm 7, 8. The signals of the sensors 9, 10 are connected by way of connecting lines 11, 12 to an electronic unit 13, which exhibits another connection 14 to the electric motor 4. The electronic unit is designed to evaluate at least two extremities-based signals for the purpose of regulating and/or controlling the crank movement.

Thus, the sensors 9, 10 make it possible to find the extremities-based measurement values that give information about which load is acting on the respective crankarm 7, 8.

These extremities-based measurement values are sent to the electronic unit 13, which on the basis of said values regulates and/or controls the electric motor 4 and thus the connected pedals 3.

However, extremities-based measurement values can also be found in that only one sensor is attached to a crankarm and another variable is found that gives information about how large the total load on the crank is. From the measurement value, which reflects the total load, and the measurement value of a sensor, reflecting the load on a crankarm, the load on the second crankarm can be found by forming the difference. Thus, there are in turn two extremities-based measurement values (for example, in the form of a torque), that can be used by the electronic unit 13 to regulate and/or control the motor 4.

An extremities-based measurement value that gives information about the load on the respective crankarm, can also be obtained in the form of a signal, which reflects the muscular activity of, for example, the legs of a person training.

Table of Reference Numerals

1 movement training device
2 crank
3 pedal
4 electric motor
5 V-belt drive
6 drive shaft
7 crankarm
8 crankarm
9 sensor
10 sensor
11 line
12 line
13 electronic unit
14 connection

What is claimed is:

1. A movement training device, comprising:

two moveable actuating elements adapted for a pair of person's extremities;

at least one of a driving and braking device couplable with said two movable actuating elements;

an electronic unit that regulates and/or controls the movement of the actuating elements, said electronic unit being coupled with said at least one driving and braking device;

sensors that determine extremities-based measurement values providing information about which load is acting on a respective one of said two movable actuating elements; and wherein on the basis of the extremities-based measurement values of at least one extremity, said electronic unit regulates and/or controls the movement of said actuating elements.

2. Movement training device, as claimed in claim 1, wherein the electronic unit selects, as a function of the extremities-based measurement values of at least one extremity, a regulating and/or control function for regulating and/or controlling the movement of the actuating elements.

3. Movement training device, as claimed in claim 1, wherein the electronic unit uses the extremities-based measurement values of at least one extremity as the regulating and/or control variable for a regulating and/or control function for regulating and/or controlling the movement of the actuating elements.

4. Movement training device, as claimed in claim 1, wherein the electronic unit uses either the measurement values of the one or the other extremity as the regulating and/or control variable for a regulating and/or control function for regulating and/or controlling the movement of the actuating elements.

5. Movement training device, as claimed in claim 1, wherein the electronic unit uses extremities-based measurement values of both extremities in a specifiable weighting as the regulating and/or control variable for a regulating and/or control function for regulating and/or controlling the movement of the actuating elements.

6. Movement training device, as claimed in claim 1, wherein the actuating elements are coupled together and are driven and/or braked by the driving and/or braking device.

7. Movement training device, as claimed in claim 1, wherein the actuating elements are connected together by a mechanism that presets an elliptical path for the actuating elements.

8. Movement training device, as claimed in claim 2, wherein the electronic unit uses the extremities-based measurement values of at least one extremity as the regulating and/or control variable for a regulating and/or control function for regulating and/or controlling the movement of the actuating elements.

9. Movement training device, as claimed in claim 2, wherein the electronic unit uses either the measurement values of the one or the other extremity as the regulating and/or control variable for a regulating and/or control function for regulating and/or controlling the movement of the actuating elements.

10. Movement training device, as claimed in claim 3, wherein the electronic unit uses either the measurement values of the one or the other extremity as the regulating and/or control variable for a regulating and/or control function for regulating and/or controlling the movement of the actuating elements.

11. Movement training device, as claimed in claim 2, wherein the electronic unit uses extremities-based measurement values of both extremities in a specifiable weighting as the regulating and/or control variable for a regulating and/or control function for regulating and/or controlling the movement of the actuating elements.

12. Movement training device, as claimed in claim 3, wherein the electronic unit uses extremities-based measurement values of both extremities in a specifiable weighting as the regulating and/or control variable for a regulating and/or control function for regulating and/or controlling the movement of the actuating elements.

13. Movement training device, as claimed in claim 4, wherein the electronic unit uses extremities-based measurement values of both extremities in a specifiable weighting as the regulating and/or control variable for a regulating and/or control function for regulating and/or controlling the movement of the actuating elements.

14. Movement training device, as claimed in claim 2, wherein the actuating elements are coupled together and are driven and/or braked by the driving and/or braking device.

15. Movement training device, as claimed in claim 3, wherein the actuating elements are coupled together and are driven and/or braked by the driving and/or braking device.

16. Movement training device, as claimed in claim 4, wherein the actuating elements are coupled together and are driven and/or braked by the driving and/or braking device.

17. Movement training device, as claimed in claim 5, wherein the actuating elements are coupled together and are driven and/or braked by the driving and/or braking device.

18. Movement training device, as claimed in claim 2, wherein the actuating elements are connected together by a mechanism that presets an elliptical path for the actuating elements.

19. Movement training device, as claimed in claim 3, wherein the actuating elements are connected together by a mechanism that presets an elliptical path for the actuating elements.

20. Movement training device, as claimed in claim 4, wherein the actuating elements are connected together by a mechanism that presets an elliptical path for the actuating elements.

* * * * *